United States Patent [19]

Taubner et al.

[11] Patent Number: 4,924,141

[45] Date of Patent: May 8, 1990

[54] ALUMINUM OXIDE REFLECTOR LAYER FOR FLUORESCENT LAMPS

[75] Inventors: Fred R. Taubner, Danvers; Richard L. Doucette, Beverly; Gerald B. Fredrickson, Danvers, all of Mass.

[73] Assignee: GTE Products Corporation, Danvers, Mass.

[21] Appl. No.: 929,691

[22] Filed: Nov. 12, 1986

[51] Int. Cl.[5] ..... H01J 61/35

[52] U.S. Cl. ..... 313/488; 313/489; 313/113

[58] Field of Search ..... 313/488, 489, 113

[56] References Cited

U.S. PATENT DOCUMENTS

| | | | |
|---|---|---|---|
| 3,141,990 | 7/1964 | Ray | 313/488 |
| 3,717,781 | 2/1973 | Sadoski et al. | 313/489 X |
| 4,012,655 | 3/1977 | McVey et al. | 313/27 |

*Primary Examiner*—Kenneth Weider
*Attorney, Agent, or Firm*—Martha Ann Finnegan

[57] ABSTRACT

An improved fluorescent lamp is disclosed. The lamp of the present invention includes an envelope containing an ionizable medium including mercury and having electrodes located within the envelope; an aluminum oxide reflector layer on the inner surface of the envelope, and a phosphor layer disposed on the reflector layer. The aluminum oxide reflector layer comprises particles of high purity aluminum oxide having an average particle size greater than 0.5 micrometer and less than or equal to about 1 micrometer and having a surface area of about 4 to 6 meter$^2$/gram. The aluminum oxide reflector layer preferably includes at least 95 weight percent alpha-alumina. Preferred coating weights for the reflector layer are from about 8.8 to about 11.1 milligram/square centimeter.

16 Claims, 1 Drawing Sheet

ALUMINUM OXIDE REFLECTOR LAYER FOR FLUORESCENT LAMPS

BACKGROUND OF THE INVENTION

The present invention relates to fluorescent lamps and more particularly to fluorescent lamps including a reflector layer.

Various coatings of non-luminescent particulate materials have been found to be useful when applied as an undercoating for the phosphor layer in fluorescent lamps. In a fluorescent lamp, the phosphor coating is disposed on the inner surface of the lamp glass envelope in receptive proximity to the ultraviolet radiation being generated by the mercury discharge. The luminous efficiency of such lamps is improved by back reflection of the incident radiation being emitted from the phosphor layer.

Examples of non-luminescent particulate materials which have been used as reflector layers in fluorescent lamps such as, for example, aperture fluorescent reprographic lamps, include titanium dioxide, mixture of titanium dioxide and up to 15 weight percent aluminum oxide, aluminum, and silver. Titanium dioxide is typically used for the reflector layer in commercially available aperture fluorescent reprographic lamps. Preferred materials chosen to act as the reflector layer do not absorb either incident ultraviolet radiation or visible radiation being emitted by the phosphor.

In some instances a reflector layer is used to permit reduction in the phosphor coating weight. See, for example, U.S. Pat. No. 4,079,288 to Maloney et al., issued on 14 Mar. 1978. U.S. Pat. No. 4,074,288 discloses employing a reflector layer comprising vapor-formed spherical alumina particles having an individual particle size range from about 400 to 5000 Angstroms in diameter in fluorescent lamps to enable reduction in phosphor coating weight with minor lumen loss. The lamp data set forth in the patent, however, shows an appreciable drop in lumen output at 100 hours.

There still remains a significant need for further improvement in lumen output of a fluorescent lamp including a reflector layer during the lifetime of the lamp.

SUMMARY OF THE INVENTION

In accordance with the present invention there is provided a fluorescent lamp comprising a glass envelope containing an ionizable medium including mercury and having electrodes located within said envelope; an aluminum oxide reflector layer on the inner surface of the envelope, the aluminum oxide reflector layer comprising particles of aluminum oxide having an average particle size greater than 0.5 micrometers and less than or equal to about 1 micrometer and having a surface area of about 4 to about 6 meter$^2$/gram; and a phosphor coating disposed over the aluminum oxide reflector layer.

For a better understanding of the present invention, together with other and further objects, advantages, and capabilities thereof, reference is made to the following disclosure and appended claims in connection with the above-described drawings.

DETAILED DESCRIPTION

In accordance with the present invention it has been found that the performance of mercury vapor lamps, more particularly, fluorescent lamps, can be improved by including an aluminum oxide reflector layer comprising particles of aluminum oxide having an average particle size greater than 0.5 micrometers and less than or equal to about 1 micrometer and having a surface area of about 4 to about 6 meter$^2$/gram.

The aluminum oxide particles used to form the aluminum oxide reflector layer, or coating, are high purity aluminum oxide, i.e., the aluminum oxide particles used comprise at least 99.0% by weight $Al_2O_3$. Preferably, the aluminum oxide particles comprise greater than or equal to 99.95% by weight $Al_2O_3$. The weight percent aluminum oxide represents the degree of purity of the aluminum oxide used.

The aluminum oxide reflector layer preferably includes at least 95 weight percent alpha-alumina. Most preferably, greater than 95% by weight of the aluminum oxide used to form the reflector layer is alpha-aluminum.

A preferred coating weight for the aluminum oxide reflector layer is about 6.9 to about 11.1 milligrams/square centimeter. Most preferably, the coating weight of aluminum reflector layer is about 8.8 to about 11.1 milligrams/square centimeter.

In accordance with the present invention, such aluminum oxide reflector layer is included in a fluorescent lamp. The fluorescent lamp of the present invention includes an envelope having a pair of electrodes sealed therein, a fill of inert gas at a low pressure, a small quantity of mercury, an aluminum oxide reflector coating deposited on the inner surface of the lamp envelope and a phosphor coating deposited on and coextensive with the reflector layer.

The lamp of the present invention may optionally include additional coatings for various other purposes.

Figure 1:
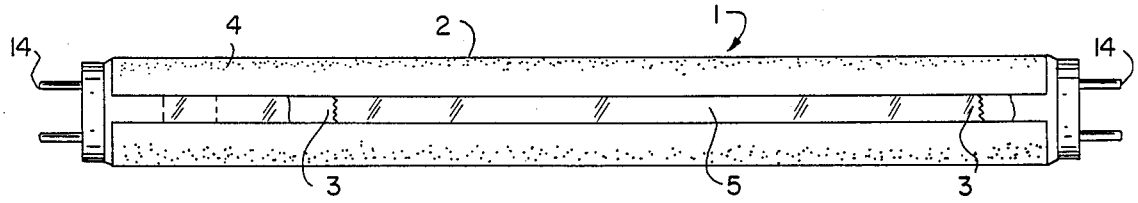
FIG. 1 is an elevational view of an aperture fluorescent reprographic lamp having an aluminum oxide reflector coating in accordance with one embodiment of the present invention.

Referring to FIG. 1, there is shown a reprographic aperture embodiment of a fluorescent lamp in accordance with the present invention.

An aperture fluorescent reprographic lamp is a high output or very high output type fluorescent lamp which is designed with a phosphor coating extending part way around the lamp and in such a manner as to leave a slot of clear glass along the length of the lamp. The slot of clear glass may extend the full length of the envelope as shown, for example, in FIG. 1 of U.S. Pat. No. 3,141,990 to J. G. Ray or, alternatively, may extend substantially the full length of the lamp envelope as shown in FIG. 1 of U.S. Pat. No. 3,886,396 to Hammer et al. The purpose of this construction is to concentrate a beam of light through the clear glass section.

The aperture fluorescent reprographic lamp 1, shown in FIG. 1, comprises an elongated glass, e.g., soda lime silica glass, envelope 2 of circular cross-section. It has the usual electrodes 3 at each end of the envelope 2 supported on lead-in wires (not shown). The sealed envelope, or tube, is filled with an inert gas, such as argon or a mixture of inert gases, such as argon and neon, at a low pressure, for example 2 torr; and a small quantity of mercury is added, at least enough to provide a low vapor pressure of, for example, about six (6) microns during operation.

Figure 2:
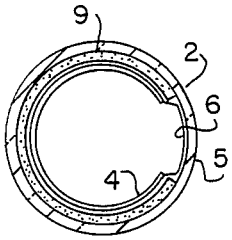
FIG. 2 is a cross-sectional view of an embodiment of the present invention.

The coating on the inner surface of the envelope of a preferred reprographic aperture embodiment is shown in cross-section in FIG. 2. A major portion of the inner surface of the tubular glass envelope is first coated with an aluminum oxide reflector layer 9 in accordance with the present invention. An aperture, or opening, 5 is mechanically scraped. In the preferred embodiment shown in FIG. 2, a protective coating 6 is applied over the reflector coating 9 and over the aperture 5.

A phosphor layer 4 is coated over the portion of the protective coating which is disposed on the reflector coating so as to leave the window clear of phosphor. In other words, the phosphor layer is coextensive with the reflector coating.

In an alternative embodiment of an aperture fluorescent reprographic lamp (not shown) the protective coating covers only that portion of the inner surface of the envelope not coated with the reflector layer and coextensive phosphor layer. In other words, the protective coating only covers the aperture. In a still further embodiment, the protective coating can also be applied to the entire inner surface of the envelope, beneath the reflector layer.

The protective coating is transparent and typically comprises a refractory oxide, for example, a clear coating of $TiO_2$ or submicron particle aluminum oxide, e.g., Aluminum Oxide C. (Manufactured by DeGussa, Inc.). It is important to note that the aperture should only be protectively coated to such an extent that the direct passage of light therethrough is not substantially affected and the tube remains transparent but still prevents attack of the glass by mercury vapor or mercury vapor compounds.

The aluminum oxide reflector layer of the present invention is preferably applied to the envelope by fully coating the lamp surface with a water base-poly(ethylene oxide) suspension of the above-described aluminum oxide particles. The suspension further includes a positive charge provided by, for example, acetic acid, to provide a homogeneous dispersion of the aluminum oxide particles in the reflector coating suspension. The coated envelope is then baked to remove the organic binder. The phosphor coating is applied thereover by conventional lamp processing techniques.

In an aperture type lamp, the aperture or opening is mechanically scraped before the baking step. The phosphor coating is applied to a lamp having an aperture the full length of the envelope by, for example, roll-coating the phosphor suspension over the reflector layer leaving the aperture window clear. The lamp is then baked to remove the organic binder.

In an aperture type lamp, the aperture utilized in the tube is to be determined by the amount of light derived. Aperture sizes can range, for example, from about 20° to about 90°. The brightness in the aperture area increases as the aperture width is reduced. A preferred aperture size is 45°.

LAMP TEST DATA

Conventional High Output (H.O.) 22.5 inch T8 aperture fluorescent reprographic lamps were fabricated with 45° apertures. The procedure used to fabricate test Lamps I–IV included the following steps:

(1) Each lamp was fully coated with the $Al_2O_3$ reflector layer of the present invention or a $TiO_2$ reflector layer using a water base suspension system; (The $Al_2O_3$ coating suspension included acetic acid, while the $TiO_2$ coating suspension included ammonium hydroxide.)

(2) A 45° aperture was mechanically scraped in each lamp;

(3) After the aperture was scraped, each lamp with the reflector coating was baked to remove the organic binder, i.e., poly(ethylene oxide), used in the water base suspension system;

(4) Each lamp was next fully coated with a transparent protective coating of Aluminum Oxide C (manufactured by DeGussa, Inc.) using an organic base suspension and baked a second time, (the protective coating is a very thin layer having a typical thickness of, for example, 5 micrometers);

(5) Each lamp was then roll-coated with an organic base suspension of the desired phosphor; the roll-coating was performed so as to leave the aperture window clear; and (6) Each lamp underwent a final bake and was then processes into a finished lamp using conventional fluorescent lamp manufacturing techniques.

The aluminum oxide reflector layer included aluminum oxide particles having an average particle size of about 0.85 micrometers and a surface area of about 4–6 meter$^2$/gram. The aluminum oxide reflector layer contained at least 95% by weight alpha-alumina. The aluminum oxide used for the reflector layer had a purity of at least 99.95% $Al_2O_3$. The aluminum oxide particles were High Purity Alumina Grade RC-HPT DBM obtained from Reynolds Metals Company - Chemical Division, Little Rock, Ark.

Preferred layer weights used in 22.5 inch T8 aperture fluorescent reprographic lamps fabricated as described by steps (1)–(6) were nominally: about 1.3–1.4 grams for a $TiO_2$ reflector layer; about 3.0–4.8 grams (or about 6.9–11.1 mg/cm$^2$) for a $Al_2O_3$ reflector layer; about 0.075–0.085 grams for the $Al_2O_3$ protective coating; and 1.7–2.2 grams for the phosphor. Most preferably, the aluminum oxide reflector layer weight is about 3.8–4.8 grams (or about 8.8–11.1 mg/cm$^2$).

The lamp test data for three lamps fabricated as described in foregoing steps (1)–(6) are shown in Table I. The values listed for light output are in microwatts/cm$^2$.

Lamps I and II employed a layer of green-emitting zinc orthosilicate phosphor, Type No. 2285 obtained from the Chemical and Metallurgical Division of GTE Products Corporation, Towanda, Pa., the individual particles of which were coated with a nonparticulate, conformal aluminum oxide coating using a method similar to the method of the preferred embodiment of U.S. Pat. No. 4,585,673 entitled "Method for Coating Phosphor Particles" by A. Gary Sigai, issued 29 Apr. 1986, which is hereby incorporated herein by reference.

Prior to coating, the phosphor powder was sieved through a 400 mesh screen and admixed with an Aluminum Oxide C fluidizing aid. (Aluminum Oxide C is manufactured by DeGussa, Inc.). The admixture contained 0.05 weight percent Aluminum Oxide C with respect to the phosphor. Four hundred grams of the admixture were loaded into a reactor designed in accordance with the schematic representation shown in FIG. 1 of U.S. Pat. No. 4,585,673.

The coating parameters were:

| | |
|---|---|
| Carrier Gas Flow ($N_2$) | 500 cc/min |
| Alkyl bubbler flow ($N_2$) | 150 cc/min |

-continued

| | |
|---|---|
| Oxygen carrier flow ($N_2$) | 50 cc/min |
| Oxygen flow | 500 cc/min |
| Frit area temperature | 200° C. |
| Bubbler temperature | 30° C. |
| Hot zone (highest temperature) | 550° C. |
| Coating time | 10¼ hours |

The coating precursor material was trimethyl aluminum. The calculated aluminum oxide ($Al_2O_3$) coating thickness was about 150 Angstroms. The surface area of the uncoated phosphor was about 0.36 meter$^2$/gram.

Lamp III employed a cerium terbium magnesium hexa-aluminate phosphor, Type No. 2293 obtained from the Chemical and Metallurgical Division of GTE Products Corporation, Towanda, Pa.

A fourth aperture lamp, Lamp IV, employing cerium-terbium magnesium hexa-aluminate phosphor and an alumina reflector layer was fabricated and separately tested. Lamp IV was also a 22.5 inch T8 aperture lamp and was fabricated by a method including steps similar to steps (1)–(6) described above. The cerium terbium magnesium hexa-aluminate phosphor employed was Type No. 2293 obtained from the Chemical and Metallurgical Division of GTE Products Corporation, Towanda, Pa. The maintenance data for Lamp IV is set forth in Table II.

A comparison of the 300 hour maintenance data for Lamp I (using a conventional $TiO_2$ reflector layer) and Lamp II (using an aluminum oxide reflector layer in accordance with the present invention) shows a 12.2% improvement in maintenance for a lamp including an aluminum oxide reflector coating in accordance with the present invention.

A gross comparison of the 300 hour maintenance data for Lamp III (using a conventional $TiO_2$ reflector layer) and separately fabricated and tested Lamp IV (using an aluminum oxide reflector coating in accordance with the present invention) shows a significant improvement in maintenance for a lamp including an aluminum oxide reflector coating in accordance with the present invention.

Additional lamp test data was obtained using High Output (H.O.) 24.5 inch T8 aperture fluorescent reprographic lamps with 45° apertures. The procedure used to fabricate test Lamps V–VII included the following steps:

(1) Each lamp was fully coated with the $Al_2O_3$ reflector layer of the present invention or a $TiO_2$ reflector layer using a water base suspension system; (The $Al_2O_3$ coating suspension included acetic acid, while the $TiO_2$ coating suspension included ammonium hydroxide.)

(2) A 45° aperture was mechanically scraped in each lamp;

(3) After the aperture was scraped, each lamp with the reflector coating was baked to remove the organic binder, i.e., poly(ethylene oxide), used in the water base suspension system;

(4) Each lamp was next fully coated with a transparent protective coating of Aluminum Oxide C (manufactured by DeGussa, Inc.) using an organic base suspension and baked a second time, (the protective coating is a very thin layer having a typical thickness of, for example, 5 micrometers);

(5) Each lamp was then roll-coated with a water base suspension of the desired phosphor; the roll-coating was performed so as to leave the aperture window clear; and (6) Each lamp underwent a final bake and was then processed into a finished lamp using conventional fluorescent lamp manufacturing techniques.

Preferred layer weights used in 24.5 inch T8 aperture fluorescent reprographic lamps fabricated as described by steps (1)–(6) were nominally: about 1.3–1.4 grams for a $TiO_2$ reflector layer; about 3.25–5.2 grams (or about 6.9–11.1 mg/cm$^2$) for a $Al_2O_3$ reflector layer; about 0.075–0.085 grams for the $Al_2O_3$ protective coating; and 1.7–2.2 grams of the phosphor. More preferably, the aluminum oxide reflector layer weight is about 4.1–5.2 grams (or about 8.8–11.1 mg/cm$^2$).

The lamp test data for Lamps V–VII, fabricated as described in foregoing steps (1)–(6), are shown in Table III. The values listed for light output are in microwatts/cm$^2$.

Lamps V–VII employed a layer of green-emitting cerium-terbium magnesium aluminate phosphor Type No. 2293 manufactured by N. V. Philips' Gloeilampenfabrieken, Eindhoven, Nederland. Lamp V employed a conventional $TiO_2$ reflector layer while Lamps VI and VII employed an aluminum oxide reflector layer in accordance with the present invention.

Lamps V and VI include phosphor layers having typical phosphor weights. Lamp VII, however, included a phosphor layer having a reduced phosphor weight.

A comparison of the 100 hour, 500 hour, and 1000 hour maintenance data for Lamp V, employing the conventional $TiO_2$ reflector layer, with that for Lamps VI and VII, in accordance with the present invention, shows a dramatic improvement in maintenance for lamps using the aluminum oxide coating of the present invention.

Additionally, a comparison of the maintenance data for Lamp VII, in accordance with the present invention, having a reduced phosphor weight, with Lamp V (using $TiO_2$ reflector layer) and Lamp VI in accordance with the present invention surprisingly shows a maintenance improvement for lamps in accordance with the present invention having a reduced phosphor weight. More specifically, Lamp VII experienced only a 2.4% maintenance loss after 100 hours of operation; and after 1000 hours of operation Lamp VII had still experienced only a 4.2% maintenance loss.

While there have been shown and described what are considered preferred embodiments of the present invention, it will be apparent to those skilled in the art that various changes and modifications may be made therein without departing from the invention as defined by the appended claims.

TABLE I

| | Refl. | Refl. Wt. (Gms) | Phosphor Optical Density | Phosphor Wt. (Gms) | 1 Hour | 100 Hours | 1–100 | 300 Hours | % M 1–300 | 1000 Hours | % M 1–1000 |
|---|---|---|---|---|---|---|---|---|---|---|---|
| Lamp I | $TiO_2$ | 1.35 | 78.5 | 1.72 | 90.4 | 83.2 | 92.1 | 76.4 | 84.6 | Discontinued | — |
| Lamp II | $Al_2O_3$ | 4.5 | 78.7 | 2.08 | 112.9 | 111.7 | 98.9 | 109.3 | 96.8 | 100.8 | 89.4 |
| Lamp III | $TiO_2$ | 1.35 | 79.8 | 1.87 | 111.6 | 105.9 | 94.9 | 100.8 | 90.3 | 92.9 | 83.2 |

TABLE II

| | | | | | | | | | | | |
|---|---|---|---|---|---|---|---|---|---|---|---|
| Lamp IV | $Al_2O_3$ | 4.5 | 79.6 | 2.03 | 140.1 | 138.9 | 99.1 | 139.1 | 99.3 | Discontinued | — |

TABLE III

| | Refl. | Refl. Wt. | Phos. Wt. | 1 Hr | 100 Hr | % Maint 1-100 Hr | 500 Hr | % Maint 1-500 Hr | 1000 Hr | % Maint 1-1000 Hr |
|---|---|---|---|---|---|---|---|---|---|---|
| Lamp V | $TiO_2$ | 1.45 | 1.2 | 122.4 | 111.0 | 90.6 | 100.6 | 82.2 | 95.7 | 78.2 |
| Lamp VI | $Al_2O_3$ | 3.63 | 1.0 | 128.6 | 125.1 | 97.3 | 122.8 | 95.5 | 121.1 | 94.1 |
| Lamp VII | $Al_2O_3$ | 3.63 | 0.5 | 120.9 | 118.0 | 97.6 | 116.6 | 96.4 | 115.9 | 95.8 |

What is claimed is:

1. A fluorescent lamp comprising:

an envelope containing an ionizable medium including mercury and having electrodes located therein;

an aluminum oxide reflector layer on the inner surface of said envelope, said aluminum oxide reflector layer comprising particles of aluminum oxide having an average particle size greater than 0.5 micrometers and less than or equal to about 1 micrometer and having a surface area of about 4 to about 6 meter$^2$/gram; and a phosphor layer disposed upon said reflector layer within said envelope.

2. A fluorescent lamp in accordance with claim 1 wherein said aluminum oxide reflector layer has a coating weight of about 8.8 to about 11.1 milligrams/square centimeter.

3. A fluorescent lamp in accordance with claim 1 wherein said aluminum oxide reflector comprises at least 99% by weight aluminum oxide.

4. A fluorescent lamp in accordance with claim 1 wherein the aluminum oxide reflector layer comprises at least 95 weight percent alpha-alumina.

5. A fluorescent lamp in accordance with claim 4 wherein the aluminum oxide particles have an average particle size of about 0.85 micrometer.

6. An aperture fluorescent reprographic lamp comprising:

an elongated vitreous glass envelope containing an ionizable medium including mercury and having electrodes at each end of said envelope;

an aluminum oxide reflector layer on the inner surface of said envelope, said aluminum oxide reflector layer comprising particles of aluminum oxide having an average particle size greater than 0.5 micrometers and less than or equal to about 1 micrometer and having a surface area of about 4 to about 6 meter$^2$/gram;

a protective coating comprising submicron particle aluminum oxide disposed on the reflector layer and upon the portion of the inner surface of said envelope not covered with said reflector layer; and a phosphor layer disposed on that portion of said protective coating disposed on the reflector layer.

7. An aperture fluorescent reprographic lamp in accordance with claim 6 wherein said aluminum oxide reflector layer has a coating weight of about 8.8 to about 11.1 milligrams/square centimeter.

8. An aperture fluorescent reprographic lamp in accordance with claim 6 wherein said aluminum oxide reflector layer comprises at least 99% by weight aluminum oxide.

9. An aperture fluorescent reprographic lamp in accordance with claim 7 wherein the aluminum oxide particles have a medium particle size of about 0.85 micrometers.

10. An aperture fluorescent reprographic lamp in accordance with claim 9 wherein the aluminum oxide reflector layer comprises at least 95 weight percent alpha-alumina.

11. An aperture fluorescent reprographic lamp in accordance with claim 10 wherein said aluminum oxide reflector layer comprises greater than or equal to 99.95 weight percent aluminum oxide.

12. A fluorescent lamp in accordance with claim 5 wherein said aluminum oxide reflector layer comprises greater than or equal to 99.95 weight percent aluminum oxide.

13. A fluorescent lamp in accordance with claim 1 wherein said aluminum oxide reflector layer has a coating weight of about 6.9 to about 11.1 milligrams/square centimeter.

14. An aperture fluorescent lamp in accordance with claim 6 wherein said aluminum oxide reflector layer has a coating weight of about 6.9 to about 11.1 milligrams/square centimeter.

15. An aperture fluorescent lamp in accordance with claim 14 wherein said protective coating is not disposed over said reflector layer and covers only that portion of the inner surface of said envelope not covered with said reflector layer.

16. An aperture fluorescent reprographic lamp comprising:

an elongated vitreous glass envelope containing an ionizable medium including mercury and having electrodes at each end of said envelope;

an aluminum oxide reflector layer on a portion of the inner surface of said envelope, said aluminum oxide reflector layer comprising particles of aluminum oxide having an average particle size greater than 0.5 micrometers and less than or equal to about 1 micrometer and having a surface area of about 4 to about 6 meter$^2$/gram;

a transparent protective coating disposed on the entire inner surface of said envelope beneath said reflector layer; and a phosphor layer disposed on said reflector layer.

* * * * *